US005735803A

United States Patent [19]

Musilli et al.

[11] Patent Number: 5,735,803

[45] Date of Patent: Apr. 7, 1998

[54] MASSAGE DEVICE

[75] Inventors: Robert Musilli, 911 Bullis Rd., Elma, N.Y. 14059; Denis J. Marszalkowski, Manlius, N.Y.

[73] Assignee: Robert Musilli, Elma, N.Y.

[21] Appl. No.: 610,399

[22] Filed: Mar. 4, 1996

[51] Int. Cl.[6] ..... A61H 15/00

[52] U.S. Cl. ..... 601/129; 601/128; 601/131

[58] Field of Search ..... 601/128, 129, 601/131, 132, 120, 122, 72; 15/230.1, 230.11; 401/197, 208

[56] References Cited

U.S. PATENT DOCUMENTS

| | | | |
|---|---|---|---|
| 1,585,767 | 5/1926 | Clarke | 601/128 |
| 2,011,471 | 8/1935 | Casagrande et al. | 601/128 |
| 2,246,263 | 6/1941 | Patterson | 601/129 |
| 2,843,869 | 7/1958 | Hermance | 15/230.11 |
| 3,060,928 | 10/1962 | Lowe | 601/128 |
| 3,103,689 | 9/1963 | Borisof | 401/208 |
| 3,866,257 | 2/1975 | Cansdale, Sr. | 401/197 |
| 4,210,135 | 7/1980 | Deuser | 601/129 |
| 5,531,665 | 7/1996 | Chen | 601/132 |

FOREIGN PATENT DOCUMENTS

| | | | |
|---|---|---|---|
| 2033837 | 11/1971 | Germany | 601/129 |
| 331458 | 7/1930 | United Kingdom | 601/128 |

*Primary Examiner*—Robert A. Hafer
*Assistant Examiner*—Justine R. Yu

[57] ABSTRACT

A hand-operated massage device comprises a plurality of massaging elements supported on a shaft for independent rotation about a first axis, and a handle mounted on the shaft to extend along a second axis in an orthogonal direction relative to the first axis. The shaft is bent into a configuration such that an imaginary plane including the first axis and substantially normal to the second axis intersects the handle between front and rear ends of the handle. In this way, the handle is positioned directly over the rotatable massaging elements and extends in a direction of movement of the device.

13 Claims, 4 Drawing Sheets

FIG. 1
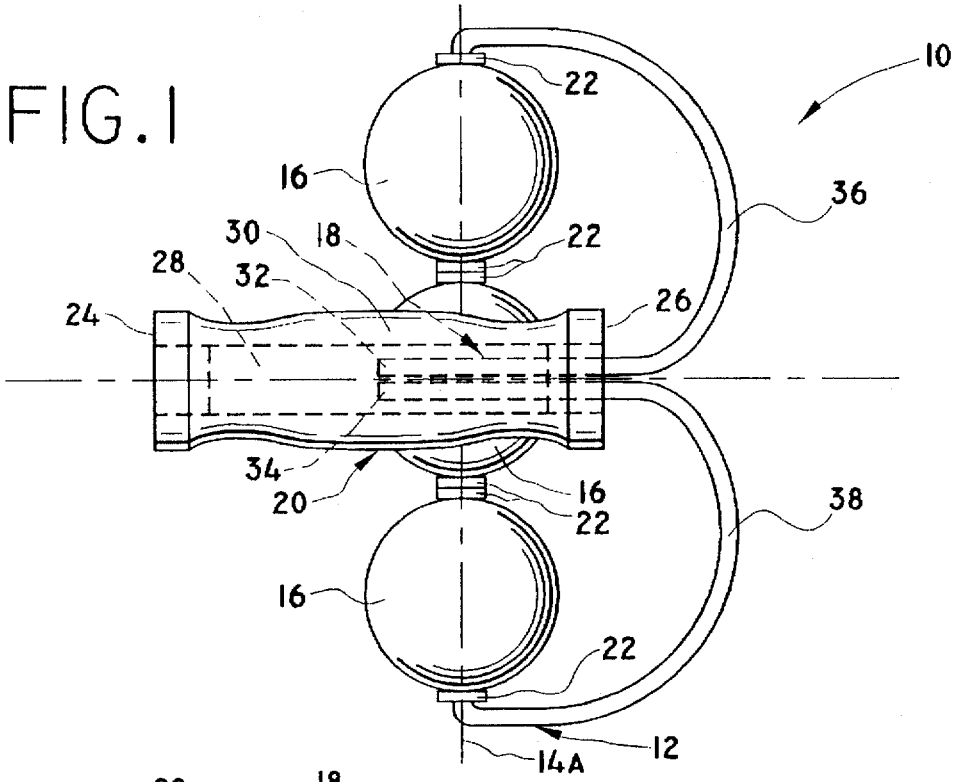
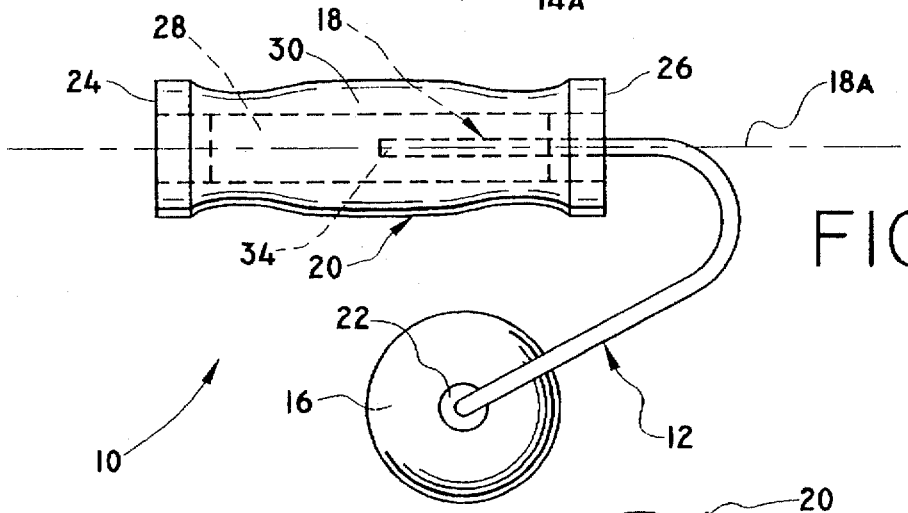
FIG. 2
FIG. 3
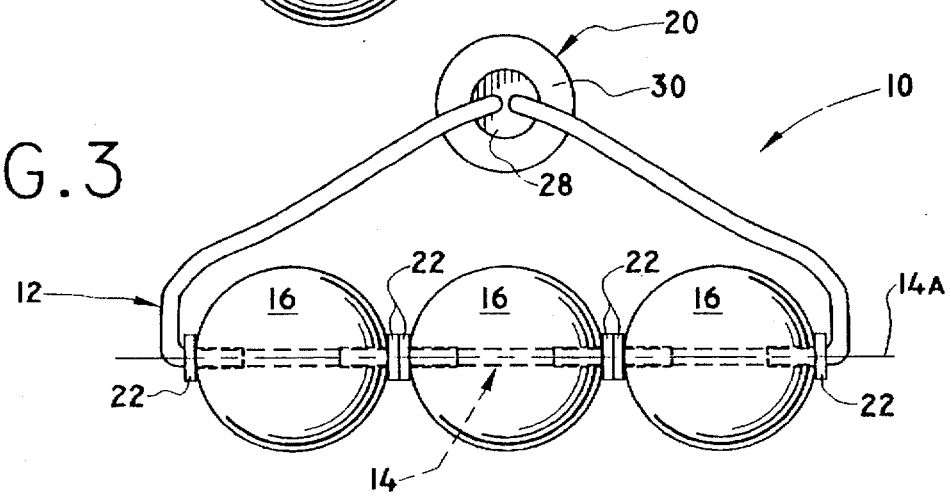

FIG. 6
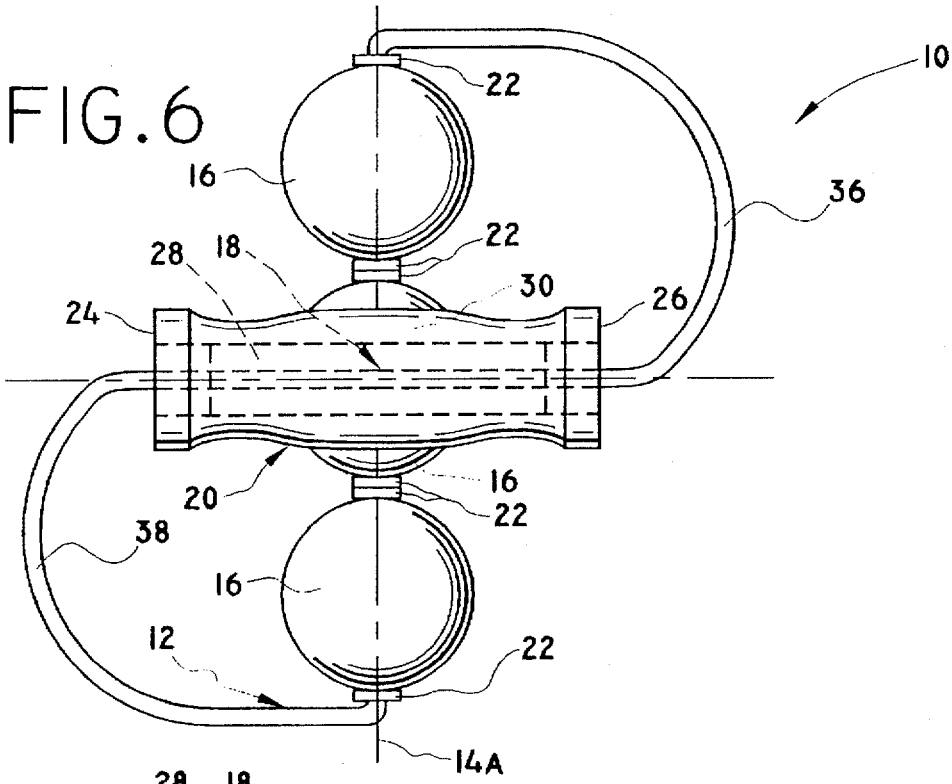
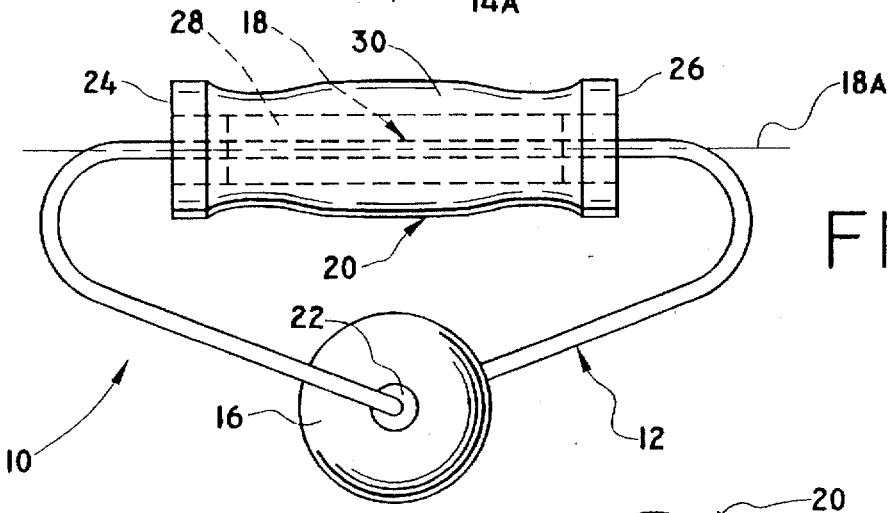
FIG. 7
FIG. 8
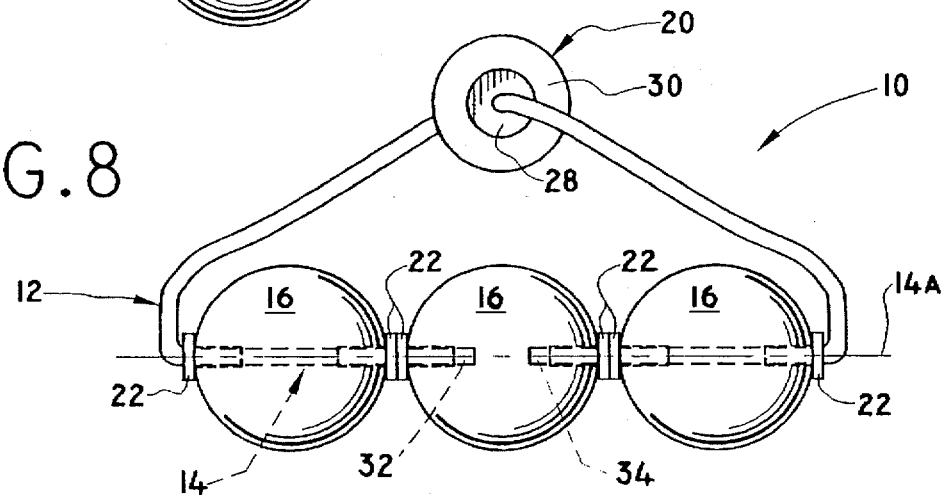

MASSAGE DEVICE

BACKGROUND OF THE INVENTION

A. Field of the Invention

The present invention relates generally to therapeutic massage devices, and more particularly to a hand held massage device having a plurality of massaging elements supported for rotation about a first axis and a handle extending along a second axis, and wherein a plane including the first axis and substantially normal to the second axis intersects the handle between opposite ends thereof.

B. Description of the Prior Art

Various prior art hand-operated massage devices are known to include a plurality of massaging elements, such as rollers or spheres, mounted for rotation about an axis defined by an axle extending between opposite legs of a generally Y-shaped frame or carrier, wherein the base of the Y defines an elongated handle portion. Examples of prior art massage devices of this type are found in U.S. Pat. Nos. 472,572; 2,246,263; 4,210,135; and 4,989,585.

The above-mentioned prior art massage devices suffer a common drawback which requires a compromise between massage pressure and directional control of the device during operation. Specifically, in such devices the most efficient position for delivering maximum massage pressure to the skin is one in which the handle axis is generally normal to the skin surface, whereas the most desirable position from a directional control standpoint is one in which the handle axis extends in a direction of movement approximately parallel to the skin surface. For instance, where a patient is lying horizontally with his or her backside facing upward for massage, an operator would have to position the handle directly above the massaging elements to increase massage pressure for a given applied force, however the massage device would be difficult to steer due to the vertical orientation of the handle. In order to improve directional control of the device, the entire device must be rotated about the axis of rotation of the massaging elements to position the handle with its longitudinal axis extending approximately in the direction of motion, i.e. with the handle generally parallel to the skin surface and behind the massaging elements, thereby substantially decreasing the massage pressure for the given applied force.

SUMMARY OF THE INVENTION

It is therefore an object of the present invention to provide a massage device which permits excellent directional control as it is moved over a patient's body, while allowing the user to apply massage pressure in an efficient manner.

It is another object of the present invention to provide a massage device which is ergonomically favorable to the user.

It is a further object of the present invention to provide a massage device which is resiliently deformable in a direction of applied massage pressure.

It is a further object of the present invention to provide a massage device with means for replaceably mounting independently rotatable massaging elements thereon.

It is a further object of the present invention to provide a massage device which is relatively simple to manufacture.

In furtherance of these and other objects, a massage device according to the present invention comprises a plurality of massaging elements supported on a shaft for independent rotation about a first axis, and a handle mounted on the shaft to extend along a second axis in an orthogonal direction relative to the first axis. The shaft is bent into a configuration such that an imaginary plane including the first axis and substantially normal to the second axis intersects the handle between front and rear ends of the handle. In this way, the handle is positioned directly over the rotatable massaging elements and extends in a direction of movement of the device.

In a preferred embodiment of the present invention, the shaft is held within an inner core portion of the handle and extends from the front end of the handle to form a pair of U-shaped portions symmetrically arranged about the second axis. In a second embodiment, the shaft is held within the inner core portion, however it extends from each of the front and rear ends of the handle to form a pair of U-shaped portions diagonally opposite each other about the second axis. In either embodiment, it is possible to arrange end portions of the shaft in end to end alignment along the first axis, such that the ends may be pulled apart enough to enable replacement of the massaging elements and returned to their original position by spring force.

BRIEF DESCRIPTION OF THE DRAWINGS

The nature and mode of operation of the present invention will now be more fully described in the following detailed description taken with the accompanying drawings wherein:

FIG. 1 is a top plan view of a massage device formed in accordance with a preferred embodiment of the present invention;

FIG. 2 is a side elevational view thereof;

FIG. 3 is a front elevational view thereof;

FIG. 6 is a top plan view of a massage device formed in accordance with a second embodiment of the present invention;

FIG. 7 is a side elevational view thereof;

FIG. 8 is a front elevational view thereof;

DETAILED DESCRIPTION OF THE PREFERRED EMBODIMENTS

Figure 4:
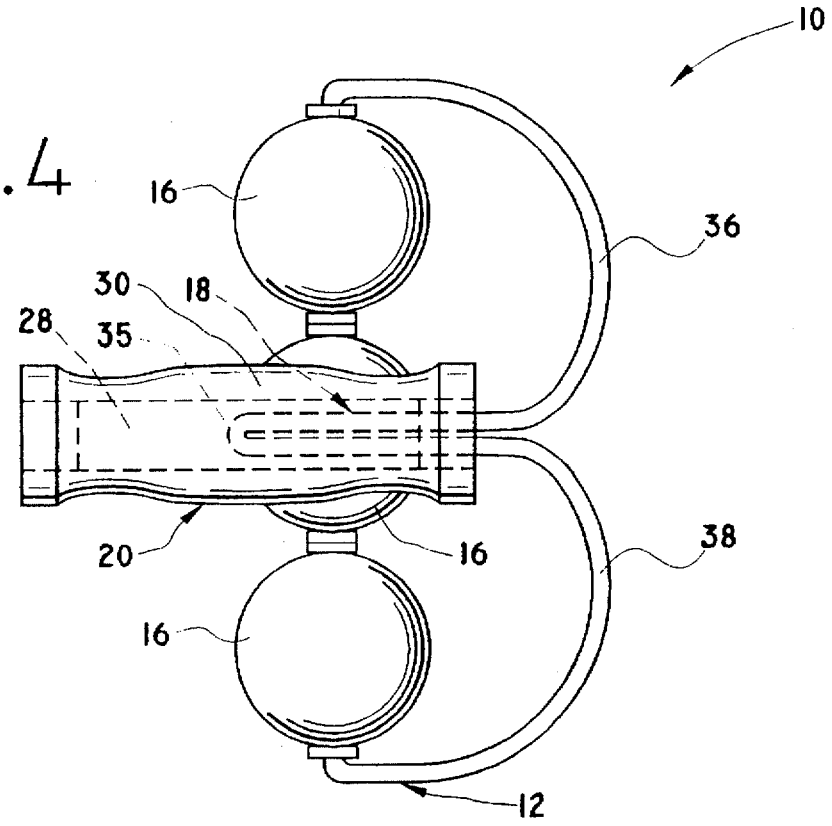
FIG. 4 is a top plan view showing a modified construction of the preferred embodiment massage device.

Referring initially to FIGS. 1–3, a massage device formed in accordance with a preferred embodiment of the present invention is illustrated and designated generally by the reference numeral 10. Massage device 10 includes a unitary metallic shaft 12 bent into a configuration which includes a straight massaging element mounting portion 14 for supporting a plurality of massaging elements 16 for rotation about a first axis 14A, and a straight handle mounting portion 18 for supporting an elongated handle 20 to extend along a second axis 18A orthogonal to first axis 14A. Massaging elements 16 are individually mounted on massaging element mounting portion 14 by respective pairs of shoulder washers 22 to permit independent rotation thereof about first axis 14A. Massaging elements are depicted as being spherical in shape, and may be smooth elastically deformable balls, however the texture, resiliency, and form of massaging elements 16 are matters of choice.

Handle 20 terminates at a rear end 24 and a front end 26, and includes a cylindrical inner core portion 28 surrounded by an outer grip portion 30. As can be seen from FIGS. 1 and 2, inner core portion 28 is shortened relative to outer grip portion 30 at ends 24 and 26 for aesthetic reasons. Outer grip portion 30 is preferably foam rubber or a similar material so as to enhance user comfort. Inner core portion 28 is formed of a rigid material, such as wood, and is adapted to receive and hold opposite end portions 32 and 34 of shaft 12. As best shown in FIG. 1, shaft end portions 32 and 34 are received within a pair of holes extending generally parallel to second axis 18A from handle front end 26 to a point generally intermediate handle ends 24 and 26. Consequently, in the embodiment of FIGS. 1–3, massaging elements 16 must be mounted on shaft 12 prior to bending the shaft and attaching the handle.

Figure 5:
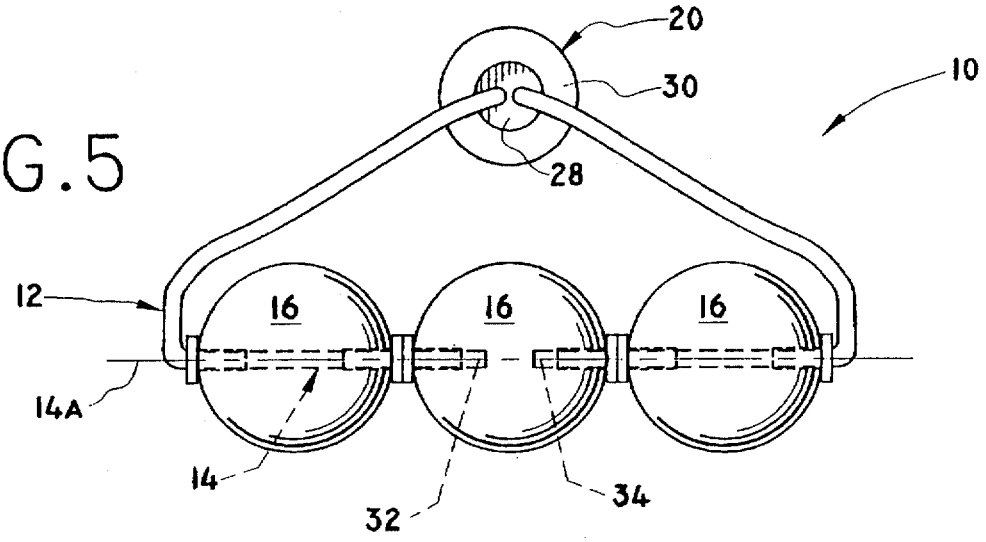
FIG. 5 is a front elevational view thereof.

A slightly modified construction of the preferred embodiment is also possible, as illustrated in FIGS. 4 and 5, wherein a narrow "hairpin" bend 35 is made in shaft 12 to form handle mounting portion 18, which is received within a suitably sized axially extending opening provided in inner core portion 28, and shaft end portions 32 and 34 are arranged in adjacent alignment along first axis 14A to form massaging element mounting portion 14. Thus, if it is desired to replace massaging elements 16 with massaging elements having different characteristics, replacement may be accomplished by pulling shaft end portions 32 and 34 apart, sliding the existing massaging elements off of shaft 12 and sliding replacement massaging elements thereon, and allowing shaft end portions 32 and 34 to return to their original positions by spring force.

The configuration of shaft 12 is symmetrical about second axis 18A, as best seen in FIGS. 1 and 4, and forms a pair of downwardly extending U-shaped portions 36 and 38 connected by massaging element mounting portion 14. It will be apparent from FIGS. 1 and 2 that an imaginary plane which includes first axis 14A, and which is substantially normal to second axis 18A, intersects handle 20 between rear end 24 and front end 26, or in other words, handle 20 is directly above and orthogonal to first axis 14A. In the preferred embodiment, such an imaginary plane intersects handle 20 generally nearer to front end 26 than to rear end 24 to reduce the chance that U-shaped portions 36 and 38 will come into contact with the skin of a patient during use.

The positioning of handle 20 above the massaging elements and orthogonal to first axis 14A in accordance with the present invention provides excellent directional manipulation of device 10 while assuring efficient use of exerted massage pressure. Uncomfortable or painful tugging of the skin during directional changes is eliminated by the provision of independently rotatable massaging elements 16 capable of rotating at different speeds. Furthermore, the configuration of shaft 12 is resiliently deformable in the direction of applied massage pressure, i.e. downward in FIG. 2, to enable massage device 10 to act in a spring-like manner, thereby enhancing the comfort and effectiveness of the device.

Figure 9:
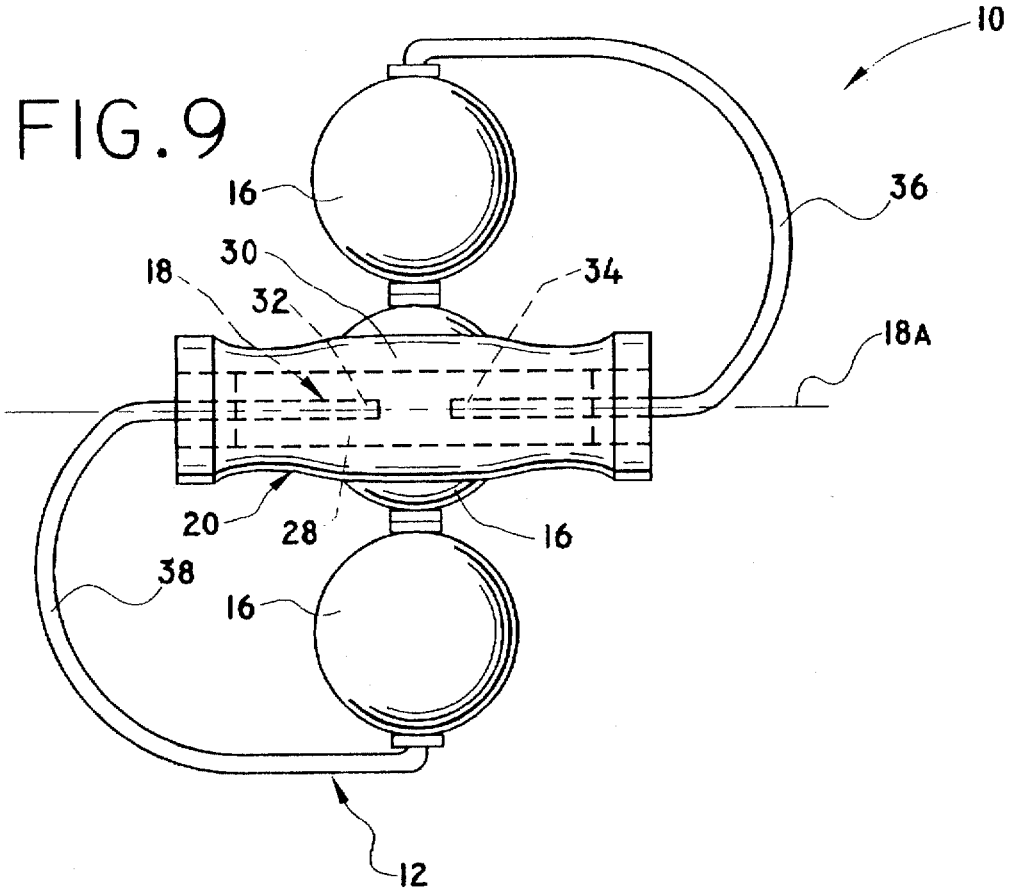
FIG. 9 is a top plan view showing a modified construction of the second embodiment massage device.
Figure 10:
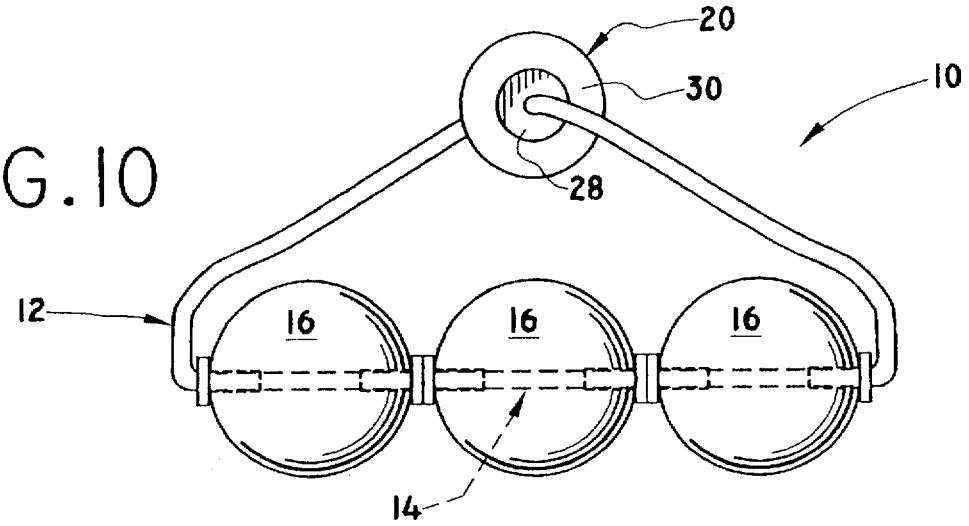
FIG. 10 is a front elevational view thereof.

FIGS. 6–8 show a further embodiment of the present invention wherein shaft 12 is configured differently. In this embodiment, shaft 12 extends from opposite handle ends 24 and 26 to form respective U-shaped portions 36 and 38 diagonally opposed about second axis 18A, and handle mounting portion 18 is a single, continuous segment received within an axially extending hole in handle inner core portion 28. Shaft end portions 32 and 34 are arranged in adjacent alignment along first axis 14A to form massaging element mounting portion 14. Consequently, in the embodiment depicted in FIGS. 6–8, handle 20 must be mounted on shaft 12 prior to bending the shaft and mounting massaging elements 16. Replacement of massaging elements 16 may be undertaken in the manner previously described herein with respect to FIGS. 4 and 5. Of course, end portions 32 and 34 may also be arranged in adjacent alignment along second axis 18A to form handle mounting portion 18 and massaging element mounting portion 14 may be a continuous segment of shaft 12, as shown in FIGS. 9 and 10, however such a modified construction precludes replacement of massaging elements 16.

The second embodiment possesses a feature of the present invention also possessed by the preferred embodiment, namely that an imaginary plane which includes first axis 14A, and which is substantially normal to second axis 18A, intersects handle 20 between rear end 24 and front end 26. More specifically to the second embodiment, the imaginary plane intersects handle 20 at a midpoint between ends 24 and 26. Accordingly, the advantages of the present invention discussed above in relation to the preferred embodiment are also exhibited by the second embodiment.

Those skilled in the art will recognize that numerous equivalent configurations exist for supporting the handle and massaging elements in the manner and relationship taught herein. Consequently, the scope of the present invention is measured by the claims appearing below.

What is claimed is:

1. A hand-held massage device comprising:

a plurality of massaging elements supported for independent rotation about a first horizontal axis;

a handle extending along a second horizontal axis orthogonal to said first axis and elevated vertically from said first axis, said handle having front and rear opposite ends on said second axis; and support means connecting said massaging elements and said handle;

wherein an imaginary vertical plane including said first axis and normal to said second axis intersects said handle between said front and rear ends.

2. The device according to claim 1, wherein said support means is resiliently deformable to provide spring loading in a direction of applied massage pressure.

3. The device according to claim 1, wherein said support means is a unitary shaft configured to include a massage element mounting portion defining said first axis, and a handle mounting portion defining said second axis.

4. The device according to claim 3, wherein said shaft is configured to extend from only said front end of said handle.

5. The device according to claim 4, wherein said plane intersects said handle nearer to said front end than said rear end.

6. The device according to claim 4, wherein said shaft includes a pair of shaft end portions, and said handle mounting portion includes said pair of shaft end portions.

7. The device according to claim 4, wherein said shaft includes a pair of shaft end portions, and said massage element mounting portion includes said pair of shaft end portions.

8. The device according to claim 7, wherein said shaft end portions are resiliently separable to permit replacement of said massaging elements.

9. The device according to claim 3, wherein said shaft is configured to extend from each of said front and rear ends of said handle.

10. The device according to claim 9, wherein said plane intersects said handle at a midpoint between said front and rear ends.

11. The device according to claim 9, wherein said shaft includes a pair of shaft end portions, and said massage element mounting portion includes said pair of shaft end portions.

12. The device according to claim 11, wherein said shaft end portions are resiliently separable to permit replacement of said massaging elements.

13. The device according to claim 9, wherein said shaft includes a pair of shaft end portions, and said handle mounting portion includes said pair of shaft end portions.

* * * * *